US005334319A

United States Patent [19]

Tomizawa et al.

[11] Patent Number: 5,334,319

[45] Date of Patent: Aug. 2, 1994

[54] COMPOSITION FOR HYDRAULIC LUBRICATION AND COUPLING

[75] Inventors: Hirotaka Tomizawa, Tokorozawa; Noboru Umemoto, Kami-Fukuoka; Hitoshi Ohenoki, Sayama, all of Japan

[73] Assignee: Tonen Corporation, Tokyo, Japan

[21] Appl. No.: 984,254

[22] Filed: Dec. 1, 1992

Related U.S. Application Data

[63] Continuation of Ser. No. 712,881, Jun. 11, 1991, abandoned.

[30] Foreign Application Priority Data

| | | | |
|---|---|---|---|
| Jun. 18, 1990 | [JP] | Japan | 2-158915 |
| Jun. 18, 1990 | [JP] | Japan | 2-158916 |
| Jun. 18, 1990 | [JP] | Japan | 2-158917 |
| Mar. 30, 1991 | [JP] | Japan | 3-067450 |
| Apr. 23, 1991 | [JP] | Japan | 3-092155 |

[51] Int. Cl.[5] ..... C10M 105/76

[52] U.S. Cl. ..... 252/46.006; 252/49.006; 252/78.003; 252/78.005

[58] Field of Search ..... 252/49.6, 46.6, 78.3, 252/78.5

[56] References Cited

U.S. PATENT DOCUMENTS

| | | | |
|---|---|---|---|
| 2,157,452 | 5/1939 | Humphreys | 252/46.6 |
| 2,629,731 | 2/1953 | Harman | 252/46.6 |
| 2,797,238 | 6/1957 | Miller | 252/46.6 |
| 3,350,348 | 10/1967 | Braid | 252/46.6 |
| 3,361,671 | 1/1968 | Lowe | 252/46.6 |
| 3,403,102 | 9/1968 | Le Suer | 252/46.6 |
| 3,423,316 | 1/1969 | Dickert | 252/46.6 |
| 3,532,730 | 10/1970 | Culpepper | 260/448.2 |
| 3,567,638 | 3/1971 | Braid | 252/46.7 |
| 3,646,172 | 2/1972 | Myers | 252/46.6 |
| 3,839,507 | 10/1974 | Hechenbleikner | 252/46.6 |
| 4,744,915 | 5/1988 | Budnik | 252/49.6 |
| 4,840,743 | 6/1989 | Gardiner | 252/49.6 |

FOREIGN PATENT DOCUMENTS

| | | |
|---|---|---|
| 0397507 | 10/1990 | European Pat. Off. . |
| 2091196 | 3/1990 | Japan . |
| 1296163 | 11/1972 | United Kingdom . |
| 2048916 | 12/1980 | United Kingdom . |
| 2206887 | 1/1989 | United Kingdom . |

OTHER PUBLICATIONS

Smallheer and Smith, "Lubricant Additives", 1967 pp. 1–11.

*Primary Examiner*—Jacqueline V. Howard
*Attorney, Agent, or Firm*—Nixon & Vanderhye

[57] ABSTRACT

A composition for hydraulic, lubricating and coupling is disclosed herein, which comprises organopolysiloxane and at least one additive selected from the group consisting of an anti-wear agent which is phosphorus type or sulfur type, a metal deactivator and a corrosion inhibitor. The composition according to the present invention further comprises an antioxidant. The composition according to the present invention can be used at high temperature for a long period, without showing a significant increase in viscosity.

3 Claims, No Drawings

COMPOSITION FOR HYDRAULIC LUBRICATION AND COUPLING

This is a continuation of application Ser. No. 07/712,881, filed Jun. 11, 1991, now abandoned.

FIELD OF THE INVENTION

The present invention relates to a composition for hydraulic, lubricating and coupling. More particularly, it relates to the composition for hydraulic, lubricating and coupling, which improve the thermal stability, whereby it can be used at high temperature for a long period without a significant increase in viscosity.

BACKGROUND OF THE INVENTION

For example, the fan coupling (fan clutch) consists of a body, which has a disc at the end of a shaft of a pump and a wheel at the end of a shaft of a fan such that the disc and the wheel are faced each other. The disc rotates with the rotation of the pump, while immersing in a viscous operating oil which is filled in the body, whereby the torque is transmitted to the wheel through the operating oil and as the result, the fan rotates.

As the operating oil for fan coupling, organopolysiloxane such as dimethylpolysiloxane and methylphenylpolysitoxane, generally having high viscosity index, is used. The organopolysiloxane is easily subjected to thermal degradation or gelation when used at high temperature because of its poor thermal stability, whereby its viscosity increases and its torque transmission ability cannot be maintained stably.

For improving the thermal stability of organopolysiloxane, it has been proposed to add an antioxidant such as iron octoate, aromatic amine derivatives and ferrocene derivatives in organopolysiloxane. When the composition comprising organopolysiloxane and the antioxidant was practically used in the fan coupling, however, the increase in viscosity was observed.

SUMMARY OF THE INVENTION

An object of the present invention is to provide a composition for a fan coupling, whose viscosity increases very slightly even when used at high temperature for a long period.

The present inventors have investigated the reason which causes the increase in viscosity of the composition for fan coupling and as the result, they supposed that when organopolysiloxane is contacted with the metal materials which constitute the wheel and the disc in the fan coupling, the metals will catalyze the degradation of organopolysiloxane, whereby the viscosity will increase.

Now, the present inventors found that by adding at least one additive selected from the group consisting of an anti-wear agent, a metal deactivator and a corrosion inhibitor, a coating is formed on a metal surface so as to retard the catalyzing action of metal, whereby the increase in viscosity of the composition can be effectively prevented.

Accordingly, the present invention provides a composition for a fan coupling, which comprises organopolysiloxane and at least one additive selected from the group consisting of an anti-wear agent, a metal deactivator and a corrosion inhibitor.

DETAILED EXPLANATION OF THE INVENTION

The organopolysiloxane, which is used as a base oil in the composition according to the present invention, has the following formula:

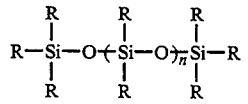

wherein each R represents hydrocarbon groups containing 1 to 18 carbon atoms, which may be halogenated, and n is an integer of 1 to 3,000.

Examples of suitable hydrocarbon groups include alkyl groups such as methyl, ethyl, n-propyl, i-propyl, n-butyl, i-butyl, t-butyl, n-pentyl, neopentyl, hexyl, heptyl, octyl, decyl and octadecyl; aryl groups such as phenyl and naphthyl; aralkyl groups such as benzyl, 1-phenylethyl and 2-phenylethyl; araryl groups such as o-, m- and p-diphenyl. Methyl and phenyl groups are preferable. Examples of suitable halogenareal hydrocarbon groups include o-, m- and p-chlorophenyl, o-, m- and p-bromophenyl, 3,3,3-trifluoropropyl, 1,1,1,3,3,3-hexafluoro-2-propyl, heptafluoro-i-propyl, heptafluoro-n-propyl and trifluoromethylphenyl. Fluorinated aromatic or aliphatic saturated hydrocarbon groups containing 1 to 8 carbon atoms are preferable.

The organopolysiloxane can be used as a mixture, such as a mixture of methylpolysiloxane and phenylpolysiloxane.

Preferably, the organopolysiloxane having the viscosity of 50 to 20,000 cSt (25° C.) is used.

The additive, which is added together with the organosiloxane in the composition according to the present invention, is at least one selected from the group consisting of the anti-wear agent, the metal deactivator and the corrosion inhibitor.

The anti-wear agent may be phosphorus type or sulfur type.

The compounds of the following formulas (I) to (VI) are exemplified as the anti-wear agent of phosphorus type.

Compound of the following formula (I):

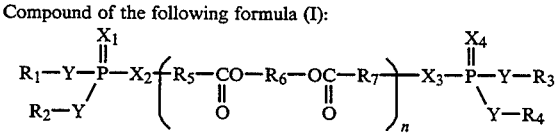

wherein each of $R_1$ to $R_4$ is hydrogen or monovalent hydrocarbon groups containing 1 to 20 carbon atoms, preferably linear and branched alkyl groups, aryl groups, aralkyl groups, araryl groups and halogenated hydrocarbon groups; each of $R_5$ to $R_7$ is divalent hydrocarbon groups containing 1 to 6 carbon atoms, preferably linear and branched alkyl groups, aryl groups, aralkyl groups, araryl groups and halogenated hydrocarbon groups; each of $X_1$ to $X_4$ is oxygen or sulfur; and Y is either absent or oxygen or sulfur; n is an integer of 0 to 2, provided that both $X_2$ and $X_3$ are sulfur when n is 0.

The description "Y is absent" herein means that $R_1$ to $R_4$ are linked to phosphorus atom directly (not through Y).

Compound of the following formula (II):

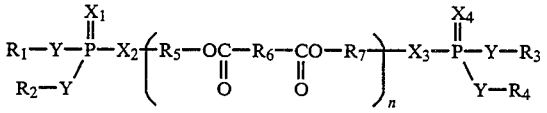

wherein $R_1$ to $R_7$, $X_1$ to $X_4$, Y and n are as defined in formula (I).

Compound of the following formula (III):

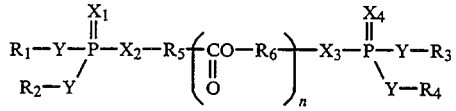

wherein each of $R_1$ to $R_4$ is hydrogen or monovalent hydrocarbon groups containing 1 to 20 carbon atoms, preferably linear and branched alkyl groups, aryl groups, aralkyl groups, araryl groups and halogenated hydrocarbon groups; each of $R_5$ and $R_6$ is divalent hydrocarbon groups containing 1 to 6 carbon atoms, preferably linear and branched alkyl groups, aryl groups, aralkyl groups, araryl groups and halogenated hydrocarbon groups; each of $X_1$ to $X_4$ is oxygen or sulfur; and Y is either absent or oxygen or sulfur; n is an integer of 0 to 2.

Compound of the following formula (IV):

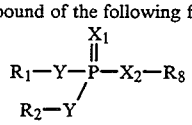

wherein each of $R_1$ and $R_2$ is hydrogen or monovalent hydrocarbon groups containing 1 to 20 carbon atoms; $R_8$ is hydrocarbon groups containing 1 to 20 carbon atoms and containing at least one ester bond; each of $X_1$ and $X_2$ is oxygen or sulfur; and Y is either absent or oxygen or sulfur.

$R_1$ to $R_4$ in the general formulas (I) to (IV) are preferably phenyl and alkylphenyl, considering the heat-resistance.

$R_1$ to $R_7$ in the general formulas (I) to (IV) contain preferably 1 to 10 carbon atoms, considering their surface adsorbing properties on metals and their solubility in organopolysiloxane.

Compound of the general formula (V):

$$(R-Y)_3-P=X_a$$

wherein R is hydrogen or hydrocarbon groups containing 1 to 20 carbon atoms, preferably linear and branched alkyl groups, aryl groups, aralkyl groups, araryl groups and halogenated hydrocarbon groups; X is oxygen or sulfur; Y is oxygen or sulfur; and a is an integer of 0 or 1.

The compound of the general formula (V) includes those having the following structure (1) to (6).

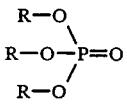

(1)

-continued

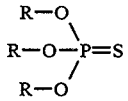

(2)

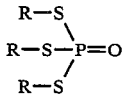

(3)

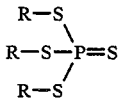

(4)

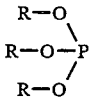

(5)

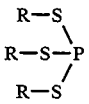

(6)

Examples of the compound having the structure (1) are phosphate esters such as propylphenyl phosphate, butylphenyl phenyl phosphate, ethyl diphenyl phosphate, allyl diphenyl phosphate, ethylphenyl diphenyl phosphate, propylphenyl diphenyl phosphate, butylphenyl diphenyl phosphate, benzyl diphenyl phosphate, cresyl diphenyl phosphate, diethylphenyl phenyl phosphate, dipropylphenyl phenyl phosphate, dibutylphenyl phenyl phosphate, dicresyl phenyl phosphate, triphenyl phosphate, tricresyl phosphate, triethylphenyl phosphate, tripropylphenyl phosphate, tributylphenyl phosphate, dibutyl phosphate and tributyl phosphate; and acid phosphate esters such as lauryl acid phosphate, stearyl acid phosphate and di-2-ethylhexyl phosphate.

Examples of the compound having the structure (2) are triphenyl phophorothionate and butyl methyl diphenyl phosphorothionate.

Examples of the compound having the structure (5) are triisopropyl phosphite and diisopropyl phosphite.

Example of the compound having the structure (6) is trilauryl thiophosphite.

The compound of the general formula (V) is preferably triarylphosphate having the structure (1) and triaryl phosphorothionate having the structure (2), considering the heat stability.

Compound of the genera formula (VI):

$$R_3-Y_b-P=X_a$$

wherein R is hydrogen or hydrocarbon groups containing 1 to 20 carbon atoms, preferably linear and branched alkyl groups, aryl groups, aralkyl groups, araryl groups and halogenated hydrocarbon groups; X is oxygen or sulfur; Y is oxygen or sulfur; a is an integer of 0 or 1; and b is an integer of 0 to 2.

The compound of the general formula (VI) includes those having the following structure (7) to (27).

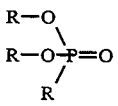

(7)

-continued (8) 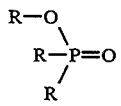

(9) 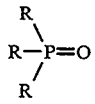

(10) 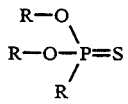

(11) 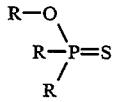

(12) 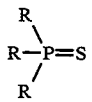

(13) 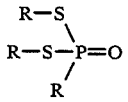

(14) 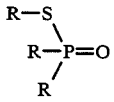

(15) 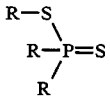

(16) 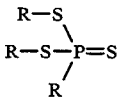

(17) 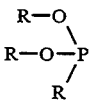

(18) 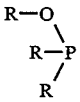

(19) 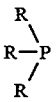

(20) 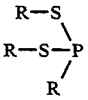

(21) 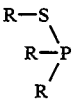

-continued

(22) 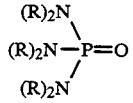

(23) 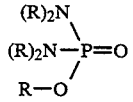

(24) 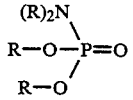

(25) 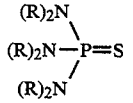

(26) 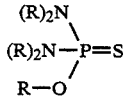

(27) 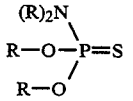

Example of the compound having the structure (7) is di-n-butylhexyl phosphonate.

Example of the compound having the structure (8) is n-butyl-n-dioctyl phosphinate.

Example of the compound having the structure (22) is hexamethylphosphoric triamide.

Example of the compound having the structure (24) is dibutyl phosphoroamidate.

Among the anti-wear agent of phosphorus type, the compounds of the general formulas (V) and (VI) are especially preferable.

The anti-wear agent of sulfur type includes sulfides such as diphenyl sulfide, diphenyl disulfide, dibenzyl disulfide, di-n-butyl sulfide, di-n-butyl disulfide, di-tert-dodecyl disulfide and di-tert-dodecyl trisulfide; sulfurized oils and fats such as sulfurized sperm oil and sulfurized dipentene; thiocarbonates such as xanthic disulfide; and zinc thiophosphates such as zinc primary-alkyl thiophosphate, zinc secondary-alkyl thiophosphate, zinc alkyl aryl thiophosphate and zinc aryl thiophosphate.

The single use of the anti-wear agent of phosphorus type or sulfur type is effective for preventing the increase in viscosity. Because the anti-wear agent absorbs on metals in the temperature range specified depending on its thermal stability, the combined use of two or more anti-wear agent of phosphorus type or sulfur type is more preferable, whereby such a combination can absorb over the wide temperature range suitable for various operating conditions of the fan coupling. Most preferably, the anti-wear agent of phosphorus type is combined with the anti-wear agent of sulfur type, as clear from the examples described below.

The anti-wear agent is used in an amount of 0.01 to 5% by weight, preferably 0.1 to 3% by weight of organopolysiloxane. When the used amount of the anti-wear agent is less than 0.01% by weight, the desired effect is not obtained. On the other hand, when it is above 5% by weight, the effect of the anti-wear agent is saturated, whereby there is no meaning using the anti-wear agent in an amount above 5% by weight. When the anti-wear agent of phosphorus type is combined with the anti-wear agent of sulfur type, it is preferably used in an amount of to 95% by weight of the total anti-wear agent.

As the metal deactivator, the following compounds are exemplified: benzotriazole and its derivative, benzothiazole and its derivative, triazole and its derivative, dithiocarbamate and its derivative, indazole and its derivative, as well as their mixture.

The metal deactivator is used in an amount of 0.001 to 1.0 by weight, preferably 0.01 to 0.5% by weight of organopolysiloxane. When the used amount of the metal deactivator is less than 0.001% by weight, the desired effect is not obtained. On the other hand, when it is above 1.0% by weight, the resultant composition will contain a large amount of precipitates.

As the corrosion inhibitor, the following compounds are exemplified: isostearate, n-octadecylammonium stearate, diamine dioleate, lead naphthenate, sorbitan oleate, pentaerythrite oleate, oleyl sarcocine, alkylsuccinic acid, alkenylsuccinic acid and their derivatives, and their mixture.

The corrosion inhibitor is used in an amount of 0.001 to 1.0% by weight, preferably 0.01 to 0.5% by weight of organopolysiloxane. When the used amount of the metal deactivator is less than 0.001% by weight, the desired effect is not obtained. On the other hand, when it is above 1.0% by weight, the resultant composition will contain a large amount of precipitates.

The single use of the metal deactivator or the corrosion inhibitor is effective for preventing the increase in viscosity. The combined use of the metal deactivator and the corrosion inhibitor, optionally together with the anti-wear agent is more preferable, as clear from the examples described below.

For further improving the thermal stability of the composition according to the present invention, the antioxidant may be contained. As the antioxidant, the following compounds are exemplified: amines such as dioctyl-diphenyl amine, phenyl-α-naphthyl amine, alkyl-diphenyl amine, N-nitroso-diphenyl amine, phenothiazine, N, N'-dinaphthyl-p-phenylene diamine, acridine, N-methylphenothiazine, N-ethyl-phenothiazine, dipyridyl amine, diphenylamine, phenolamine and 2,6-di-t-butyl-α-dimethylamino p-cresol; phenols such as 2,6-di-t-butyl pcresol, 4,4'-methylene bis(2,6-di-t-butylphenol) and 2,6-di-t-butylphenol; organic iron salts such as iron octoate, ferrocene and iron naphthoate; organic cerium salts such as cerium naphthoate and cerium toluate; organic metal compounds such as zirconium octoate; and their mixture.

The antioxidant (if present) is used in an amount of 0.001 to 5% by weight, preferably 0.01 to 2% by weight of organopolysiloxane.

If necessary, the composition according to the present invention may contain any conventional additives such as extreme pressure agent, friction modifier and color-dye agent.

The composition according to the present invention is used mainly for a fan coupling. It may be used for a viscous coupling. Further, it may be used for a shock absorber, a damper, a rashajuster, an automatic transmission, an automatic tentloner and a G-sensor, in which the organopolysiloxane based compositions are used.

PREFERABLE EMBODIMENT OF THE INVENTION

In a preferable embodiment of the present invention, the composition comprises an organopolysiloxane and the anti-wear agent of phosphorus type or sulfur type, optionally together with the antioxidant.

In other preferable embodiment of the present invention, the composition comprises an organopolysiloxane and the anti-wear agents of phosphorus type and sulfur type, optionally together with the antioxidant.

In other preferable embodiment of the present invention, the composition comprises an organopolysiloxane and the metal deactivator, optionally together with the antioxidant.

In other preferable embodiment of the present invention, the composition comprises an organopolysiloxane, the anti-wear agent and the metal deactivator, optionally together with the antioxidant.

In other preferable embodiment of the present invention, the composition comprises an organopolysiloxane and the corrosion inhibitor, optionally together with the antioxidant.

In other preferable embodiment of the present invention, the composition comprises an organopolysiloxane, the anti-wear agent and the corrosion inhibitor, optionally together with the antioxidant.

In other preferable embodiment of the present invention, the composition comprises an organopolysiloxane, the metal deactivator and the corrosion inhibitor, optionally together with the antioxidant.

In other preferable embodiment of the present invention, the composition comprises an organopolysiloxane, the anti-wear agent, the metal deactivator and the corrosion inhibitor, optionally together with the antioxidant.

EXAMPLES

The present invention now being fully described, the same will be better understood by reference to certain specific examples which are included herein for purposes of illustration only and are not intended to be limiting of the invention or any embodiment thereof, unless specified.

EXAMPLE 1

To dimethylsilicone (viscosity 1000 $mm^2/s$ at 25° C.), 1.0% by weight of diphenyl amine as the antioxidant and 0, 0.5, 1.0 or 2.0% by weight of tricresylphosphate as the anti-wear agent of phosphorus type were added. 30 ml of the resultant composition was filled in the fan coupling at 25° C.

The fan coupling was operated at 6500 rpm for 50 hours, after which the changes in viscosity and torque were tested. The results are shown in Table 1.

TABLE 1

| amount of anti-wear agent (wt %) | change in viscosity (%) | change in torque (%) |
|---|---|---|
| 2.0 | 0 | +1 |
| 1.0 | +3 | +3 |
| 0.5 | +5 | +7 |
| 0 | not measurable* | not measurable* |

*The viscosity and the torque were rapidly increased before 50 hours.

EXAMPLE 2

To dimethylsilicone (viscosity 1000 $mm^2/s$ at 25° C.), 1.0% by weight of 4,4'-methylene bis(2,6-di-t-butylphenol) as the antioxidant and 0, 0.5 or 1.0% by weight of diphenyl disulfide as the anti-wear agent of sulfur type were added. The resultant composition was tested as described in Example 1. The results are shown in Table 2.

TABLE 2

| amount of anti-wear agent (wt %) | change in viscosity (%) | change in torque (%) |
|---|---|---|
| 1.0 | +5 | +6 |
| 0.5 | +8 | +8 |
| 0 | not measurable | not measurable |

EXAMPLE 3

To dimethylsilicone (viscosity 1000 $mm^2/s$ at 25° C.), 0, 0.25 or 0.5% by weight of tricresyl phosphate as the anti-wear agent of phosphorus type and dibenzyl disulfide as the anti-wear agent of sulfur type was added. 30 ml of the resultant composition was filled in the fan coupling at 25° C.

The fan coupling was operated at 6500 rpm for 100 hours, after which the changes in viscosity and torque were tested. The results are shown in Table 3.

TABLE 3

| amount of P-type anti-wear agent (wt %) | amount of S-type anti-wear agent (wt %) | change in viscosity (%) | change in torque (%) |
|---|---|---|---|
| 0.5 | 0 | +9 | +9 |
| 0 | 0.5 | +13 | +16 |
| 0.25 | 0.25 | +4 | +5 |

EXAMPLE 4

The composition was prepared according to the procedure as described in Example 3, provided that 1.0% by weight of diphenyl amine as the antioxidant was further added. The resultant composition was tested as described in Example 3. The results are shown in Table 4.

TABLE 4

| amount of P-type anti-wear agent (wt %) | amount of S-type anti-wear agent (wt %) | change in viscosity (%) | change in torque (%) |
|---|---|---|---|
| 0.5 | 0 | +7 | +8 |
| 0 | 0.5 | +10 | +12 |
| 0.25 | 0.25 | +5 | +6 |

To the above composition comprising dimethylsilicone (viscosity 1000 $mm^2/s$ at 25° C.), 0.25% by weight of tricresyl phosphate, 0.25% by weight of dibenzyl disulfide and 1.0% by weight of diphenyl amine, 0.20% by weight of zinc di-sec-butyldithiophosphate as the additional anti-wear agent of sulfur type was added. The resultant composition showed the increase in viscosity being +2% and the increase in torque being +3%.

EXAMPLE 5

The composition was prepared according to the procedure as described in Example 4, provided that dibenzyl disulfide was replaced with olefine sulfide as the anti-wear agent of sulfur type. The resultant composition was tested as described in Example 4. The results are shown in Table 5.

TABLE 5

| amount of P-type anti-wear agent (wt %) | amount of S-type anti-wear agent (wt %) | change in viscosity (%) | change in torque (%) |
|---|---|---|---|
| 0 | 0.5 | +8 | +8 |
| 0.25 | 0.25 | +5 | +5 |

EXAMPLE 6

The composition was prepared according to the procedure as described in Example 4, provided that tricresyl phosphate was replaced with aminodibutyl phosphonate as the anti-wear agent of phosphorus type. The resultant composition was tested as described in Example 4. The results are shown in Table 6.

TABLE 6

| amount of P-type anti-wear agent (wt %) | amount of S-type anti-wear agent (wt %) | change in viscosity (%) | change in torque (%) |
|---|---|---|---|
| 0.5 | 0 | +8 | +5 |
| 0.25 | 0.25 | +3 | +4 |

EXAMPLE 7

The composition was prepared according to the procedure as described in Example 4, provided that dibenzyl disulfide was replaced with zinc di-sec-butyldithiophosphate as the anti-wear agent of sulfur type. The resultant composition was tested as described in Example 4. The results are shown in Table 7.

TABLE 7

| amount of P-type anti-wear agent (wt %) | amount of S-type anti-wear agent (wt %) | change in viscosity (%) | change in torque (%) |
|---|---|---|---|
| 0 | 0.5 | +10 | +10 |
| 0.25 | 0.25 | +5 | +6 |

EXAMPLE 8

The composition was prepared according to the procedure as described in Example 4, provided that tricresyl phosphate was replaced with triphenyl phosphorotionate as the anti-wear agent of phosphorus type. The resultant composition was tested as described in Example 4. The results are shown in Table 8.

TABLE 8

| amount of P-type anti-wear agent (wt %) | amount of S-type anti-wear agent (wt %) | change in viscosity (%) | change in torque (%) |
|---|---|---|---|
| 0.5 | 0 | +7 | +7 |
| 0.25 | 0.25 | +3 | +3 |

EXAMPLE 9

To dimethylsilicone (viscosity 1000 $mm^2/s$ at 25° C.), 0 or 0.5% by weight of tricresyl phosphate as the anti-wear agent of phosphorus type and 0.1 or 0.8% by weight of benzotriazole as the metal deactivator were added. The resultant composition was tested as described in Example 3. The results are shown in Table 9.

TABLE 9

| amount of anti-wear agent (wt %) | amount of metal deactivator (wt %) | change in viscosity (%) | change in torque (%) |
|---|---|---|---|
| 0 | 0.8 | +7 | +10 |
| 0.5 | 0.1 | +5 | +5 |

EXAMPLE 10

The composition was prepared according to the procedure as described in Example 9, provided that 1.0% by weight of diphenyl amine as the antioxidant was added and the amount of the metal deactivator was changed. The resultant composition was tested as described in Example 9. The results are shown in Table 10.

TABLE 10

| amount of anti-wear agent (wt %) | amount of metal deactivator (wt %) | change in viscosity (%) | change in torque (%) |
|---|---|---|---|
| 0 | 0 | not measurable* | not measurable* |
| 0 | 0.1 | +15 | +15 |
| 0 | 0.4 | +9 | +10 |
| 0 | 0.8 | +5 | +6 |
| 0.5 | 0.1 | +4 | +4 |

*The viscosity and the torque were rapidly increased before 100 hours.

EXAMPLE 11

The composition was prepared according to the procedure as described in Example 9, provided that the metal deactivator was replaced with n-octadecylammonium stearate as the corrosion inhibitor. The resultant composition was tested as described in Example 9. The results are shown in Table 11.

TABLE 11

| amount of anti-wear agent (wt %) | amount of corrosion inhibitor (wt %) | change in torque (%) | change in viscosity (%) |
|---|---|---|---|
| 0 | 0.8 | +7 | +8 |
| 0.5 | 0.1 | +3 | +4 |

EXAMPLE 12

The composition was prepared according to the procedure as described in Example 11, provided that 1.0% by weight of diphenyl amine was added as the antioxidant and the amount of the corrosion inhibitor was changed. The resultant composition was tested as described in Example 11. the results are shown in Table 12.

TABLE 12

| amount of anti-wear agent (wt %) | amount of corrosion inhibitor (wt %) | change in viscosity (%) | change in torque (%) |
|---|---|---|---|
| 0 | 0 | not measurable | not measurable |
| 0 | 0.1 | +16 | +16 |
| 0 | 0.4 | +10 | +10 |
| 0 | 0.8 | +6 | +8 |
| 0.5 | 0.1 | +4 | +4 |

To the above composition comprising dimethylsilicone (viscosity 1000 $mm^2/s$ at 25° C.), 1.0% by weight of diphenyl amine, 0.5% by weight of tricresyl phosphate and 0.2% by weight of n-octadecylammonium stearate, 0.1% by weight of benzotriazole was added. The resultant composition showed the increase in viscosity being +20% and the increase in torque being +4%.

We claim:

1. A fan coupling composition which comprises:

i) an organopolysiloxane having a viscosity of 1,000 to 20,000 cSt 25° C.;

ii) from 0.01 to 5%, by weight of the organopolysiloxane, of a phosphorous type anti-wear agent; and iii) from 0.01 to 2%, by weight of the organopolysiloxane, of an antioxidant; said phosphorous type anti-wear agent having one of the following formulae (I) to VII):

(I)

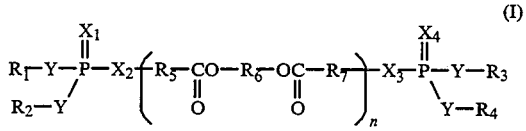

wherein each of $R_1$ to $R_4$ is independently hydrogen or a monovalent hydrocarbon group containing from 1 to 20 carbon atoms; each of $R_5$ to $R_7$ is independently a divalent hydrocarbon group containing from 1 to 6 carbon atoms; each of $X_1$ to $X_4$ is independently oxygen or sulfur; each Y is independently a direct bond, oxygen or sulfur; and n is an integer of from 0 to 2, with the proviso that both $X_2$ and $X_3$ are sulfur when n is 0;

(II)

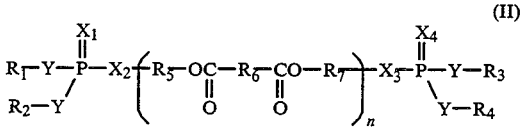

wherein $R_1$ to $R_7$, $X_1$ to $X_4$, Y and n are as defined in Formula (I);

(III)

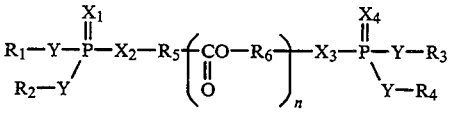

wherein each of $R_1$ to $R_4$ is independently hydrogen or a monovalent hydrocarbon group containing from 1 to 20 carbon atoms; each of $R_5$ and $R_6$ is independently a divalent hydrocarbon group containing from 1 to 6 carbon atoms; each of $X_1$ to $X_4$ is independently oxygen or sulfur; each Y is independently a direct bond, oxygen or sulfur; and n is an integer of from 0 to 2;

(IV)

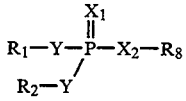

wherein each of $R_1$ and $R_2$ is independently hydrogen or a monovalent hydrocarbon group containing from 1 to 20 carbon atoms; $R_8$ is a hydrocarbon group containing from 1 to 20 carbon atoms and containing at least one ester bond; each of $X_1$ and $X_2$ is independently oxygen or sulfur; and each Y is independently a direct bond, oxygen or sulfur;

$$(R-Y)_3-P=X_a \quad \text{(V)}$$

wherein each R-y group may be identical or different, R is hydrogen or a hydrocarbon group containing from 1 to 20 carbon atoms; X is oxygen or sulfur; Y is oxygen or sulfur; and a is 0 or 1;

$$(R-Y_b)_3-P=X_a \quad \text{(VI)}$$

wherein each R-$Y_b$ group may be identical or different, R is hydrogen or a hydrocarbon group containing from 1 to 20 carbon atoms; X is oxygen or sulfur; Y is oxygen or sulfur; a is 0 or 1; and b is 0 or 1;

$$((R)_2N)_a(RO)_b-P=X \quad \text{(VII)}$$

wherein each $R_2N$ group and each RO group may be identical or different, R is hydrogen or a hydrocarbon group containing from 1 to 20 carbon atoms; X is oxygen or sulfur; a is an integer of from 1 to 3; and b is an integer of from 0 to 2, with the proviso that a+b=3.

2. A composition according to claim 1 wherein:

in formulae (I) and (II) each of $R_1$ to $R_4$ is independently hydrogen or a linear or branched alkyl group, aryl group, aralkyl group, araryl group or halogenated hydrocarbon group and each of $R_5$ to $R_7$ is independently a linear or branched alkyl group, aryl group, aralkyl group, araryl group or halogenated hydrocarbon group;

in formula (III) each of $R_1$ to $R_4$ is independently hydrogen or a linear or branched alkyl group, aryl group, aralkyl group, araryl group or halogenated hydrocarbon group and each of $R_5$ and $R_6$ is independently a linear or branched alkyl group, aryl group, aralkyl group, araryl group or halogenated hydrocarbon group; and in formulae (V) to (VII) each R is independently hydrogen or a linear or branched alkyl group, aryl group, aralkyl group, araryl group or halogenated hydrocarbon group.

3. A composition according to claim 1 or 2 further including at least one of (a) a sulfur anti-wear agent present in an amount of 0.01 to 5% by weight of the organopolysiloxane; (b) metal deactivator present in an amount of 0.001 to 1.0% by weight of the organopolysiloxane; (c) corrosion inhibitor present in an amount of 0.001 to 1.0% by weight of the organopolysiloxane.

* * * * *